US009713736B2

(12) United States Patent
Kao

(10) Patent No.: US 9,713,736 B2
(45) Date of Patent: Jul. 25, 2017

(54) DUMBBELL WITH DETACHABLE WEIGHTS

(71) Applicant: Chien-Ping Kao, Taipei (TW)

(72) Inventor: Chien-Ping Kao, Taipei (TW)

( * ) Notice: Subject to any disclaimer, the term of this patent is extended or adjusted under 35 U.S.C. 154(b) by 42 days.

(21) Appl. No.: 14/829,700

(22) Filed: Aug. 19, 2015

(65) Prior Publication Data

US 2017/0050073 A1 Feb. 23, 2017

(51) Int. Cl.

| | |
|---|---|
| ***A63B 21/075*** | (2006.01) |
| ***A63B 21/00*** | (2006.01) |
| ***A63B 23/12*** | (2006.01) |
| ***A63B 21/072*** | (2006.01) |

(52) U.S. Cl.

CPC ..... *A63B 21/075* (2013.01); *A63B 21/00061* (2013.01); *A63B 21/00069* (2013.01); *A63B 21/0726* (2013.01); *A63B 21/0728* (2013.01); *A63B 23/12* (2013.01)

(58) Field of Classification Search

CPC ... A63B 21/075; A63B 21/0726; A63B 21/06; A63B 21/0601; A63B 21/072; A63B 21/00058; A63B 21/00061; A63B 21/00065; A63B 21/0722; A63B 21/0724; A63B 21/0728; A63B 69/002

See application file for complete search history.

(56) References Cited

U.S. PATENT DOCUMENTS 4,593,903 A * 6/1986 Waitz ..... A63B 21/075 482/82
5,033,739 A * 7/1991 MacKechnie ..... A63B 21/0084 482/111
5,266,069 A * 11/1993 Thorne ..... A63B 21/0084 482/106
D344,113 S * 2/1994 Shelton ..... D21/678
5,637,064 A * 6/1997 Olson ..... A63B 21/0728 482/107
5,873,783 A * 2/1999 McBain ..... F41B 15/025 135/75
7,048,678 B2 * 5/2006 Harms ..... A63B 21/0728 482/107
7,326,158 B1 * 2/2008 Wang ..... A63B 21/06 482/132
7,922,633 B2 * 4/2011 Januszek ..... A63B 21/0728 482/107

(Continued)

*Primary Examiner* — Loan H Thanh
*Assistant Examiner* — Gregory Winter
(74) *Attorney, Agent, or Firm* — Alan D. Kamrath; Kamrath IP Lawfirm, P.A.

(57) ABSTRACT

A dumbbell with detachable weights has a handle assembly, multiple weights, a first end cap assembly, and a second end cap assembly. The handle assembly has a main support with a handle, a first end panel, and a second end panel. The weights are mounted between the first and second end panels of the main support, are arranged around the handle, and are radially detachable from the main support. The first and second end cap assemblies are respectively mounted on the first and second end panels and selectively engage with the weights. By turning a driving cap of the first end cap assembly, the first and second end cap assemblies can disengage from the weights. Since the weights can be radially mounted onto or detached from the main support, an adjusting range of the training weight of the dumbbell can be increased.

17 Claims, 12 Drawing Sheets

(56) References Cited

U.S. PATENT DOCUMENTS

| | | | | |
|---|---|---|---|---|
| 2010/0022365 | A1* | 1/2010 | Ngu | A63B 21/075<br>482/108 |
| 2012/0245000 | A1* | 9/2012 | Burke | A63B 21/075<br>482/106 |
| 2015/0360074 | A1* | 12/2015 | Jung | A63B 21/0726<br>482/108 |

* cited by examiner

DUMBBELL WITH DETACHABLE WEIGHTS

BACKGROUND OF THE INVENTION

1. Field of the Invention

The present invention relates to a dumbbell and, especially, to a dumbbell with detachable weights, such that a training weight of the dumbbell is adjustable.

2. Description of the Prior Art(s)

People utilize a variety of devices to perform weight training to improve muscle strength and endurance, enhance bone density, and so forth. Dumbbells and barbells are common devices for weight training. When performing weight training with the dumbbell, a user holds the dumbbell with one hand. A conventional dumbbell includes a handle and multiple weight plates mounted onto two opposite ends of the handle along a long axial direction of the handle. Another conventional dumbbell includes a handle and two weight portions integrally formed on two opposite ends of the handle. When performing weight training with the barbell, the user holds the barbell with both hands. A conventional barbell includes a handle and multiple weight plates mounted onto two opposite ends of the handle along a long axial direction of the handle.

Thus, the weight plates of the conventional dumbbell or barbell are mounted onto and detached from the handle along the long axial direction of the handle. Take the conventional dumbbell for example, since the weight plates are mounted onto the handle along the long axial direction of the handle, a middle portion of the handle should be reserved for the hand of the user to hold the handle. Therefore, the remaining portion of the handle for hanging the weight plates is limited. Accordingly, an adjustable range of the training weight of the conventional dumbbell is also limited.

To overcome the shortcomings, the present invention provides a dumbbell with detachable weights to mitigate or obviate the aforementioned problems.

SUMMARY OF THE INVENTION

The main objective of the present invention is to provide a dumbbell with detachable weights. The dumbbell has a handle assembly, multiple weights, a first end cap assembly, and a second end cap assembly. The handle assembly has a main support with a handle, a first end panel, and a second end panel. The weights are mounted between the first and second end panels of the main support, are arranged around the handle, and are radially detachable from the main support. The first and second end cap assemblies are respectively mounted on the first and second end panels and selectively engage with the weights.

By turning a driving cap of the first end cap assembly, the first and second end cap assemblies can disengage from the weights, such that any one of the weights can be radially detached from the main support. Since the weights can be radially mounted onto or detached from the main support, an adjusting range of training weight of the dumbbell can be increased.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
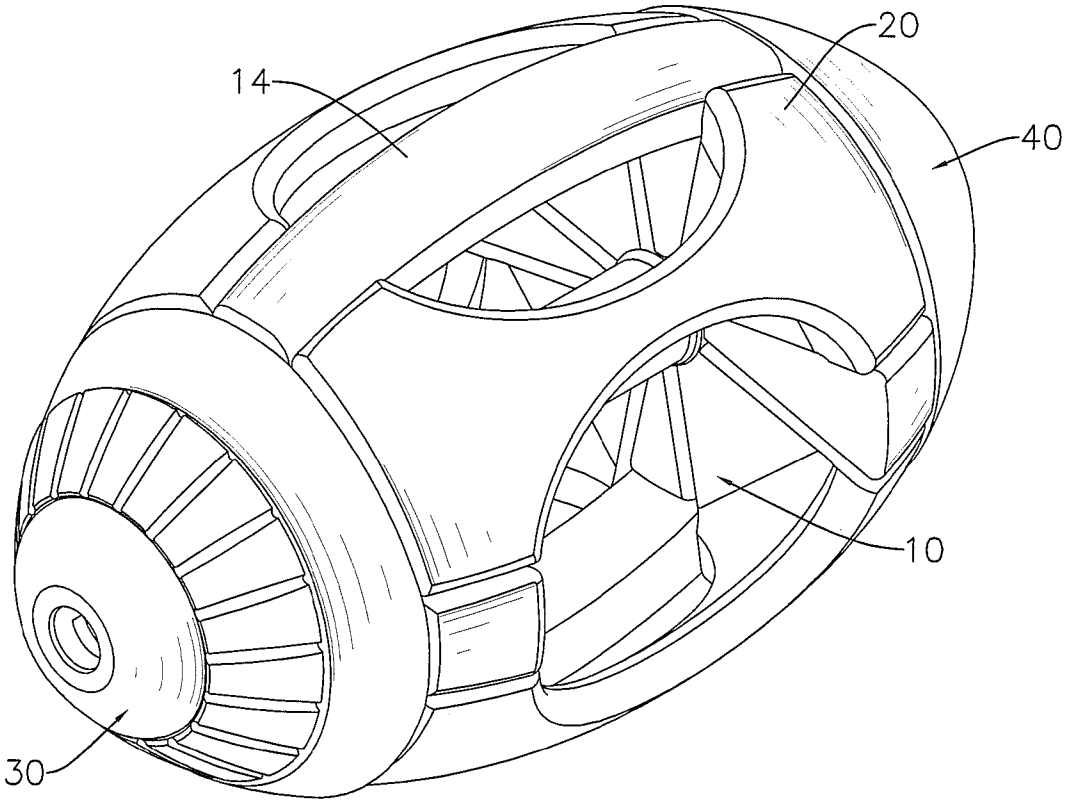
FIG. 1 is a perspective view of a dumbbell with detachable weights in accordance with the present invention.
Figure 2:
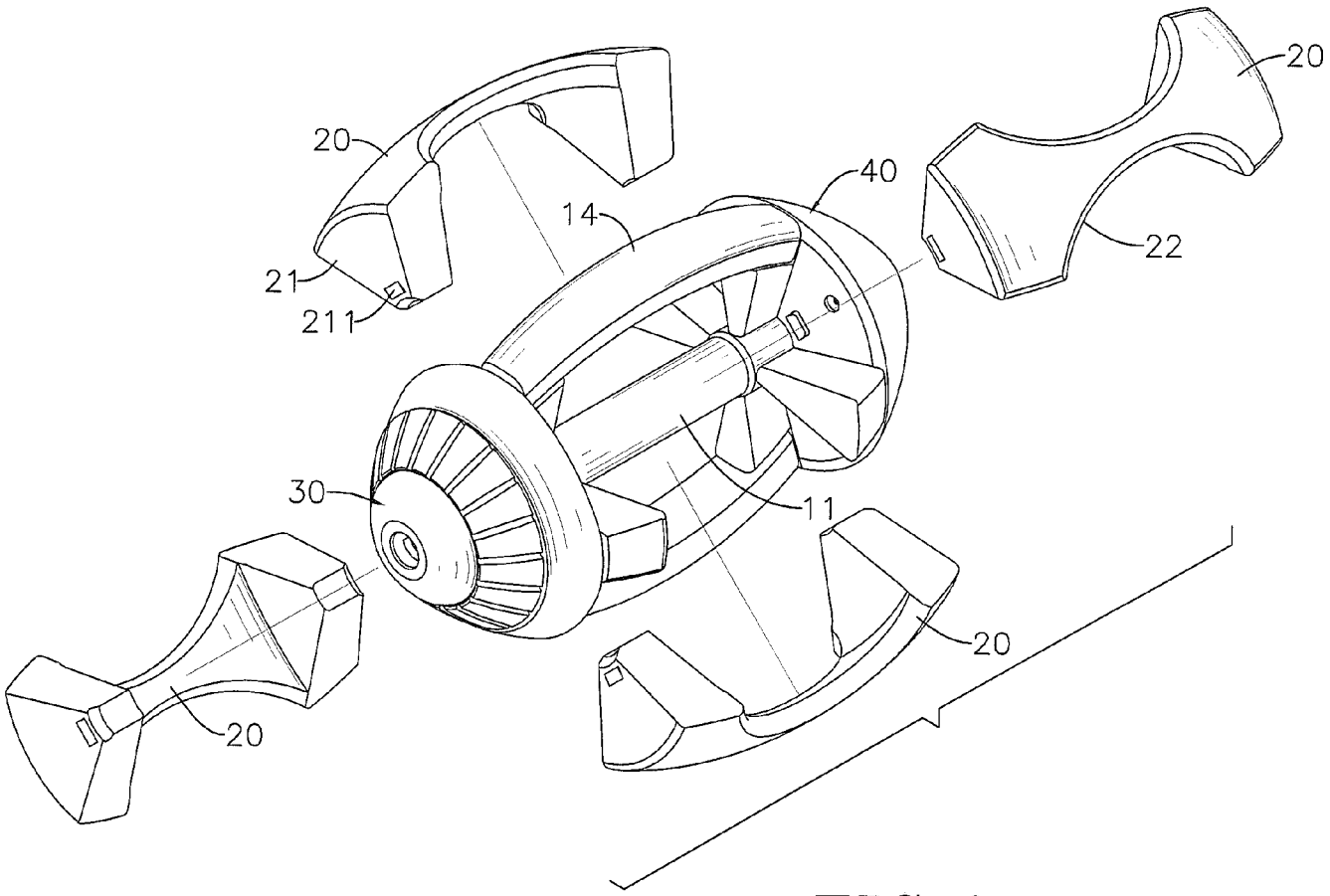
FIG. 2 is an exploded perspective view of the dumbbell in FIG. 1.

With reference to FIGS. 1 and 2, a dumbbell in accordance with the present invention is substantially olive-shaped and comprises a handle assembly 10, multiple weights 20, a first end cap assembly 30, and a second end cap assembly 40.

Figure 3:
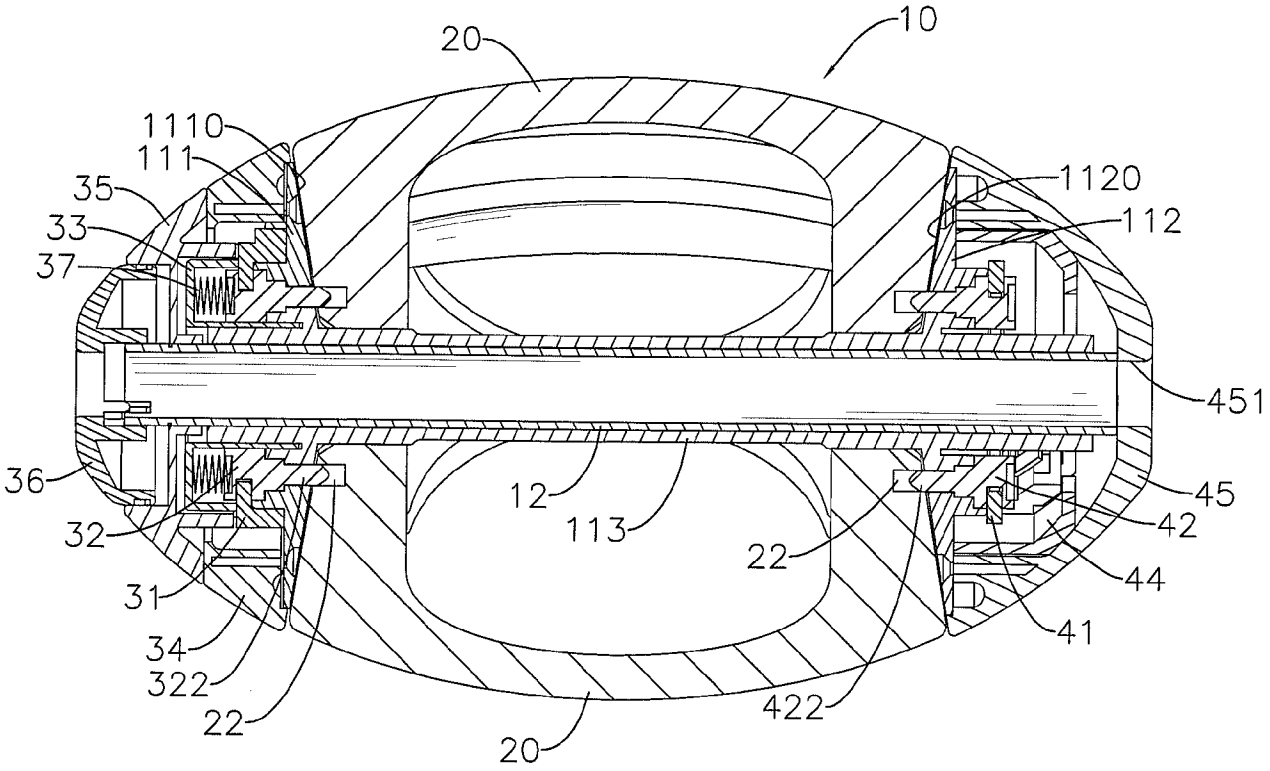
FIG. 3 is a first cross-sectional side view of the dumbbell in FIG. 1.

With further reference to FIG. 3, the handle assembly 10 includes a main support 11, an axial tube 12, at least one driving slat 13, and multiple side bars 14.

The main support 11 has a handle 113, a first end panel 111, and a second end panel 112. The handle 113 is tubular and has a first end and a second end.

Figure 4:
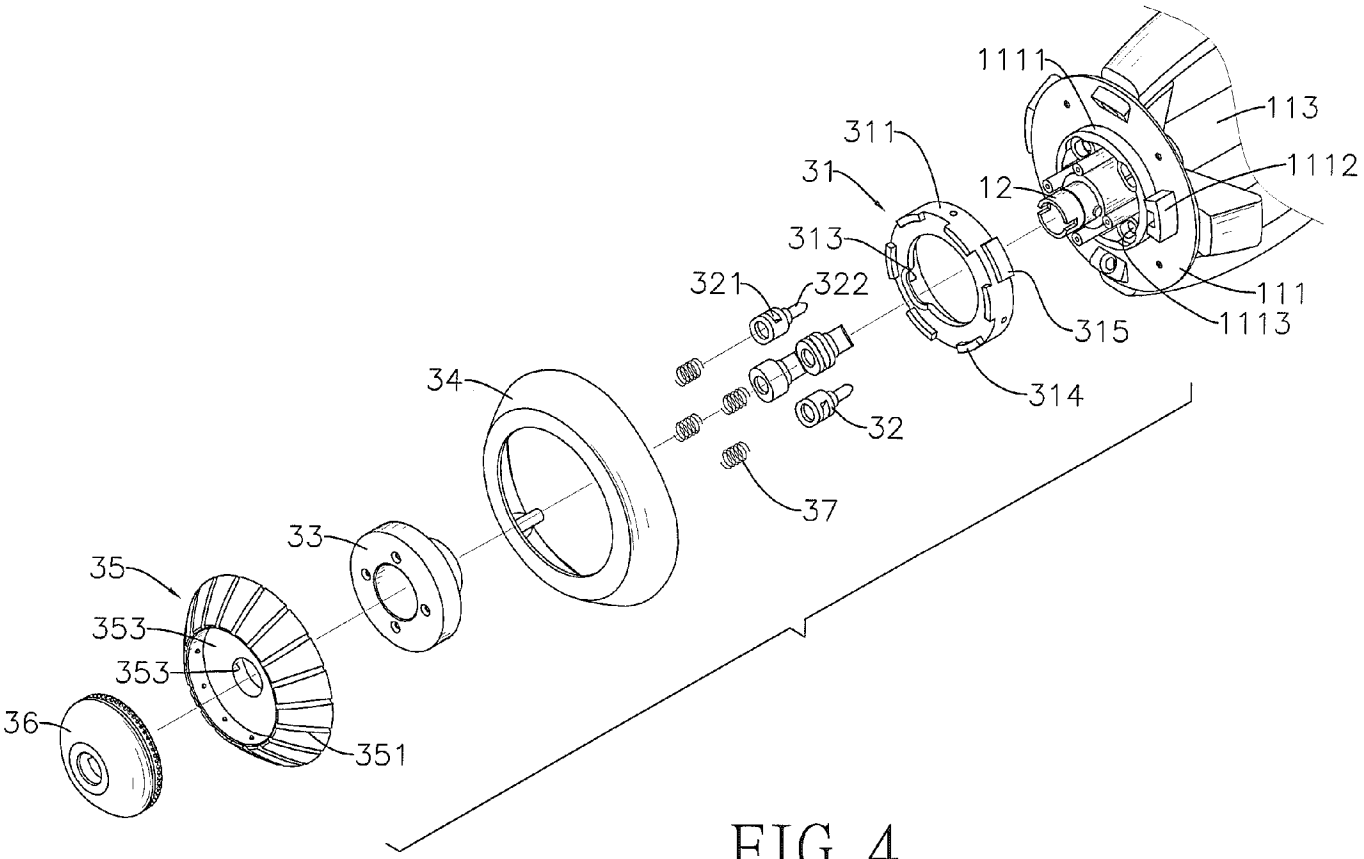
FIG. 4 is an exploded perspective view of a first end cap assembly of the dumbbell in FIG. 1.

With further reference to FIG. 4, the first end panel 111 is mounted on and around the handle 113 and is disposed adjacent to the first end of the handle 113. The first end panel 111 has an inner peripheral edge, an outer peripheral edge, an outer surface, an inner surface 1110, a first ring wall 1111, a stop protrusion 1112, and multiple mounting holes 1113. The outer surface of the first end panel 111 faces toward the first end of the handle 113. The inner surface of the first end panel 111 inclines between the inner and outer peripheral edges of the first end panel 111, such that the inner peripheral edge of the first end panel 111 is convex toward the second end of the handle 113. The first ring wall 1111 is formed on the outer surface of the first end panel 111 and surrounds the first end of the handle 113. The stop protrusion 1112 is formed on the outer surface of the first end panel 111 and is disposed between the first ring wall 1111 and the outer peripheral edge of the first end panel 111. The mounting holes 1113 of the first end panel 111 are formed through the first end panel 111, are disposed between the first ring wall 1111 and the inner peripheral edge of the first end panel 111, and are separately arranged around the first end of the handle 113.

With further reference to FIG. 4, the second end panel 112 is mounted on and around the handle 113 and is disposed adjacent to the second end of the handle 113. The second end panel 112 has an inner peripheral edge, an outer peripheral edge, an outer surface, an inner surface 1120, a second ring wall 1121, and multiple mounting holes 1122. The outer surface of the second end panel 112 faces toward the second end of the handle 113. The inner surface 1120 of the second end panel 112 faces toward the inner surface 1110 of the first end panel 111 and inclines between the inner and outer peripheral edges of the second end panel 112, such that the inner peripheral edge of the second end panel 112 is convex toward the first end of the handle 113. The second ring wall 1121 is formed on the outer surface of the second end panel 112 and surrounds the second end of the handle 113. The mounting holes 1122 of the second end panel 112 are formed through the second end panel 112, are disposed between the second ring wall 1121 and the inner peripheral edge of the second end panel 112, and are separately arranged around the second end of the handle 113. The mounting holes 1122 of the second end panel 112 respectively align with the mounting holes 1113 of the first end panel 111.

The axial tube 12 is axially mounted through the handle 113 of the main support 11 and has a first end and a second end. The first end of the axial tube 12 is positioned toward the first end of the handle 113. The second end of the axial tube 12 is positioned toward the second end of the handle 113.

Figure 9:
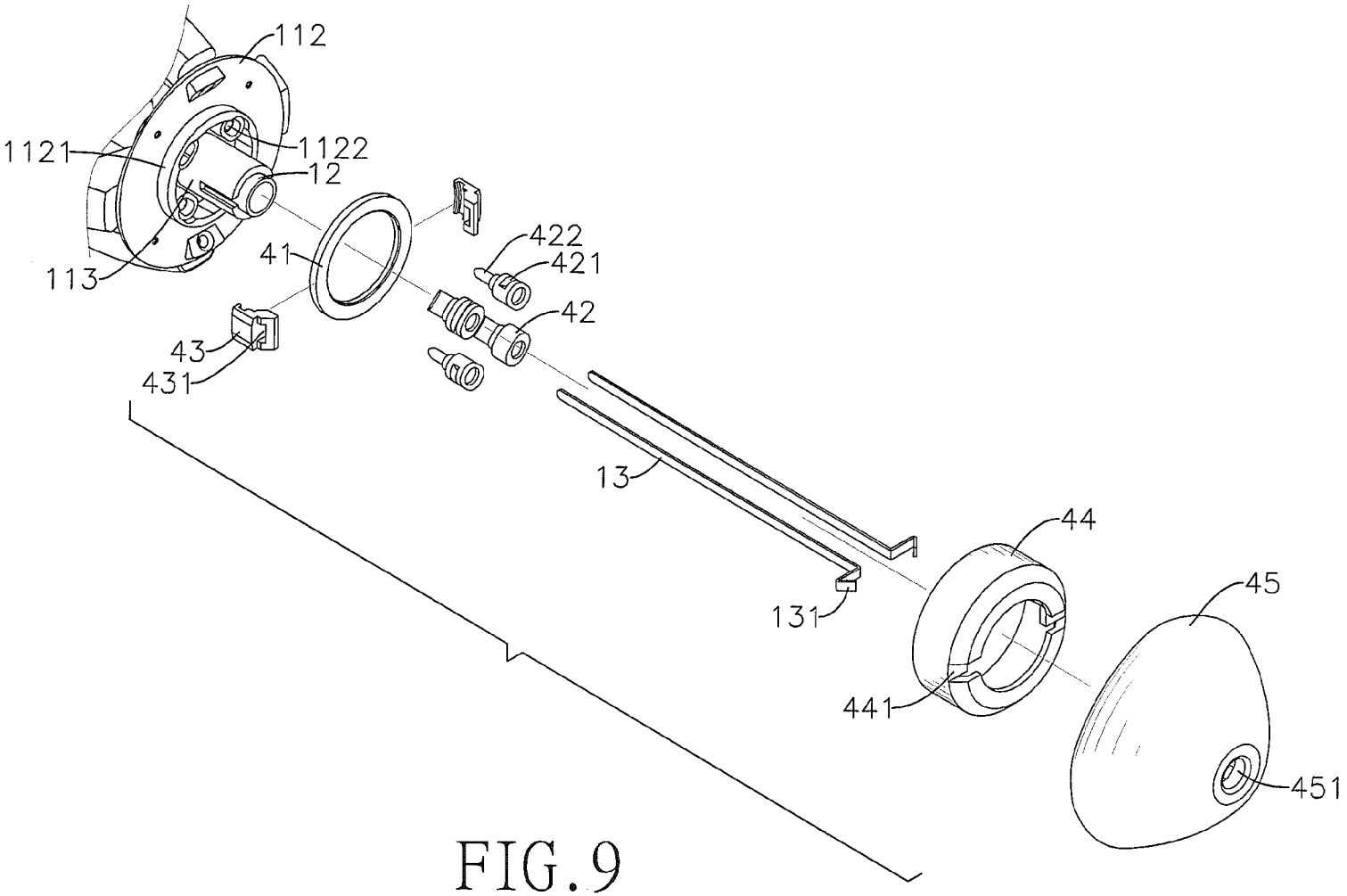
FIG. 9 is an exploded perspective view of a second end cap assembly of the dumbbell in FIG. 1.
Figure 10:
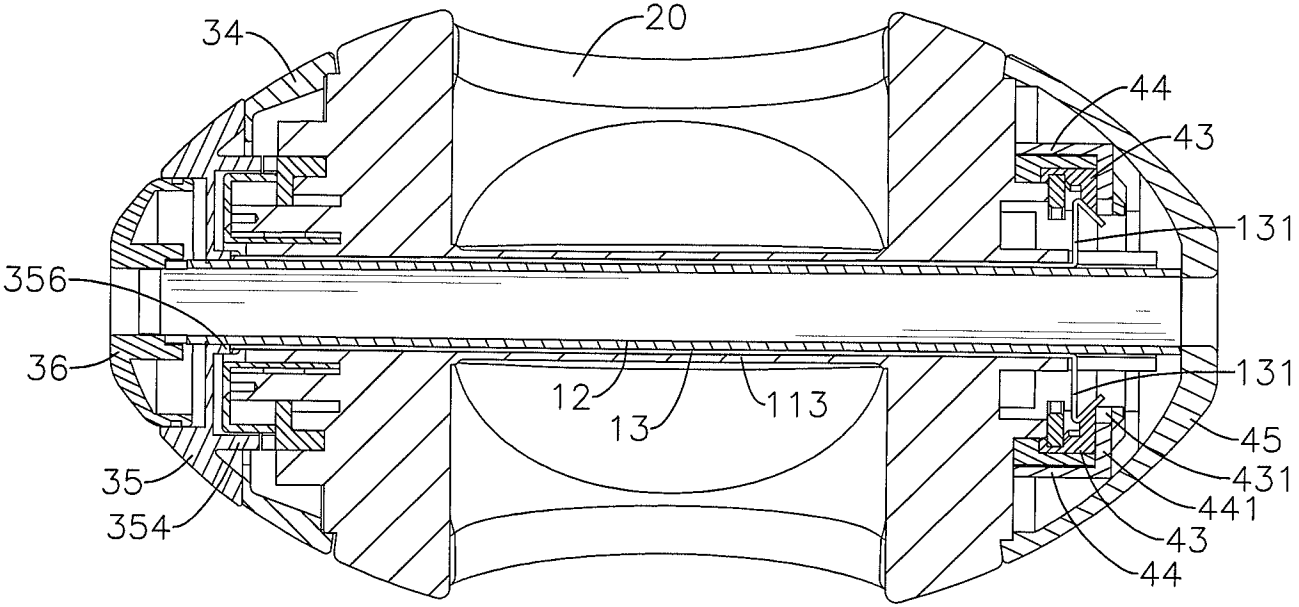
FIG. 10 is a third cross-sectional side view of the dumbbell in FIG. 1.

With further reference to FIGS. 9 and 10, the at least one driving slat 13 is mounted between the handle 113 of the main support 11 and the axial tube 12. Each of the at least one driving slat 13 is slidable along a long axial direction of the driving slat 13 and has a first end, a second end, and a pushing portion 131. The first end of the driving slat 13 protrudes out from the first end of the handle 113. The second end of the driving slat 13 protrudes out from the second end of the handle 113. The pushing portion 131 is bent and is formed on the second end of the driving slat 13.

The side bars 14 are disposed between the first and second end panels 111, 112 of the main support 11 and are separately arranged around the handle 113. Each of the side bars 14 has two ends respectively connected securely to the first and second end panels 111, 112.

The weights 20 are mounted between the first and second end panels 111, 112 of the main support 11, are arranged around the handle 113 along with the side bars 14, and are radially detachable from the main support 11. Each of the weights 20 has two end surfaces 21, two locking recesses 211, and two lateral indentations 22. The end surfaces 21 respectively correspond in position to one of the mounting holes 1113 of the first end panel 111 and one of the mounting holes 1122 of the second end panel 112. Each of the end surfaces 21 is fan-shaped in cross-section and is inclined to fit the inner surfaces 1110, 1120 of the first and second end panels 111, 112. Thus, when the weight 20 is mounted to the main support 11 along a radial direction of the first and second end panels 111, 112, the end surfaces 21 of the weight 20 abut and slide along the inner surfaces 1110, 1120 of the first and second end panels 111, 112, such that the weight 20 can be firmly mounted on the main support 11. The locking recesses 211 are respectively formed in the end surfaces 21 of the weight 20. The lateral indentations 22 are respectively formed in two opposite sides of the weight 20. Thus, the lateral indentations 22 of two of the weights 20 that are disposed next to each other and are not separated by one of the side bars 14 can form a passage. A user can hold the handle 113 with his hand through the passage.

In the preferred embodiment, the handle assembly 10 includes two side bars 14. The two side bars 14 are separately mounted on the main support 11, are 180 degrees apart, and are oppositely disposed beside the handle 113 of the main support 11. Each of the side bars 14 has two opposite sides. Each of the sides of the side bar 14 faces toward a corresponding one of the sides of the other side bar 14. The dumbbell has four weights 20. Each two of the weights 20 are mounted between the sides of the side bars 14 that face toward each other. Accordingly, the first end panel 111 has four mounting holes 1113 respectively corresponding in position to the four weights 20, and the second end panel 112 also has four mounting holes 1122 respectively corresponding in position to the four weights 20.

Figure 5:
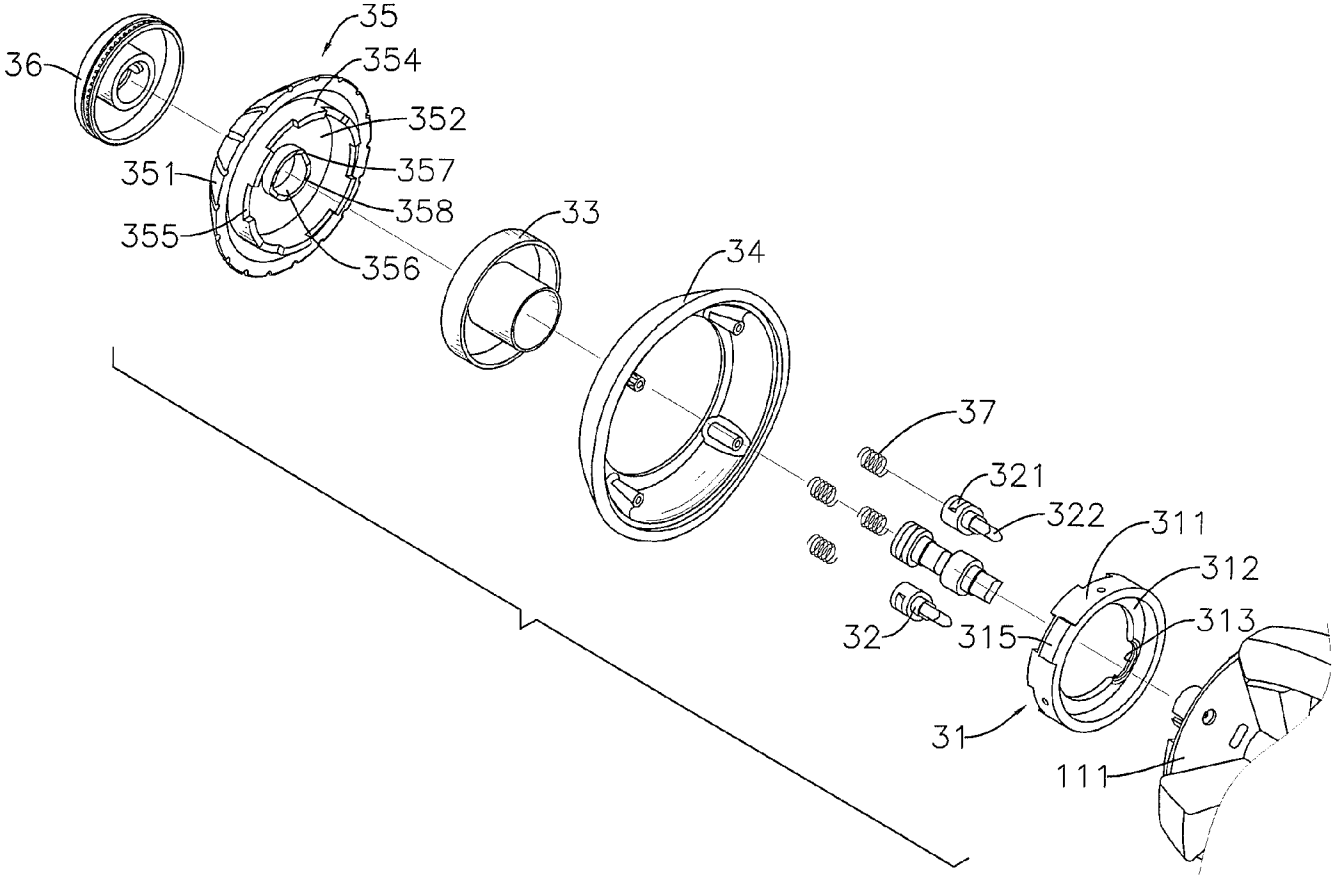
FIG. 5 is another exploded perspective view of the first end cap assembly of the dumbbell in FIG. 1.

With further reference to FIGS. 4 and 5, the first end cap assembly 30 is mounted on the first end panel 111 of the main support 11 and selectively engages with the weights 20. The first end cap assembly 30 includes an adjusting seat 31, multiple first locking elements 32, an inner holding cap 33, multiple restoring springs 37, a covering panel 34, a driving cap 35, and a first end cap 36.

Figure 6:
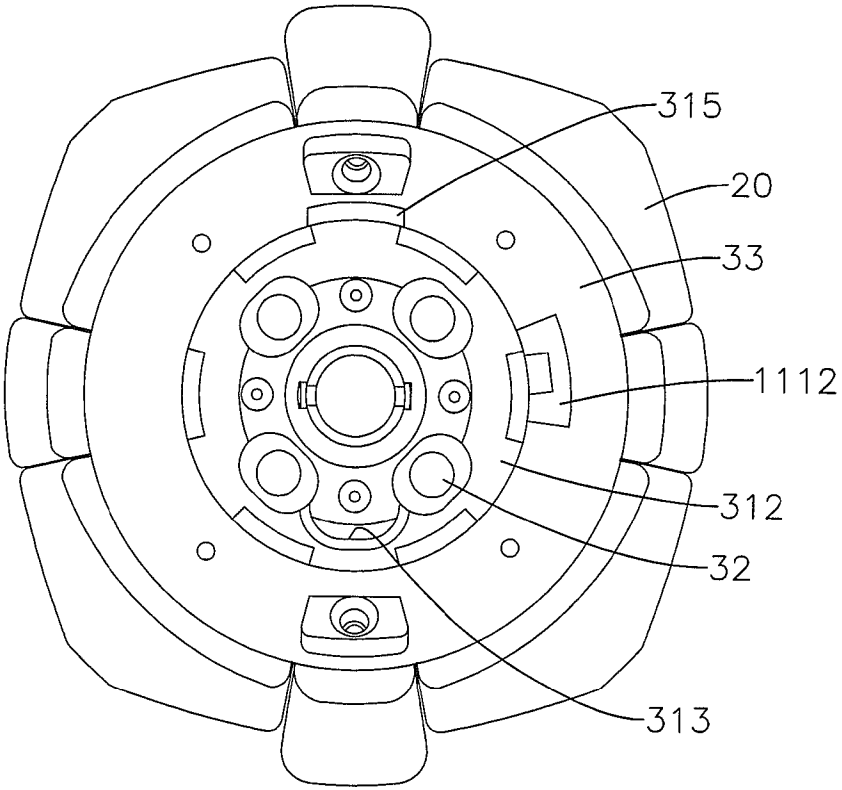
FIG. 6 is an end view of the dumbbell in FIG. 1, with a covering panel, a driving cap, and a first end cap of the first end cap assembly being omitted.
Figure 7:
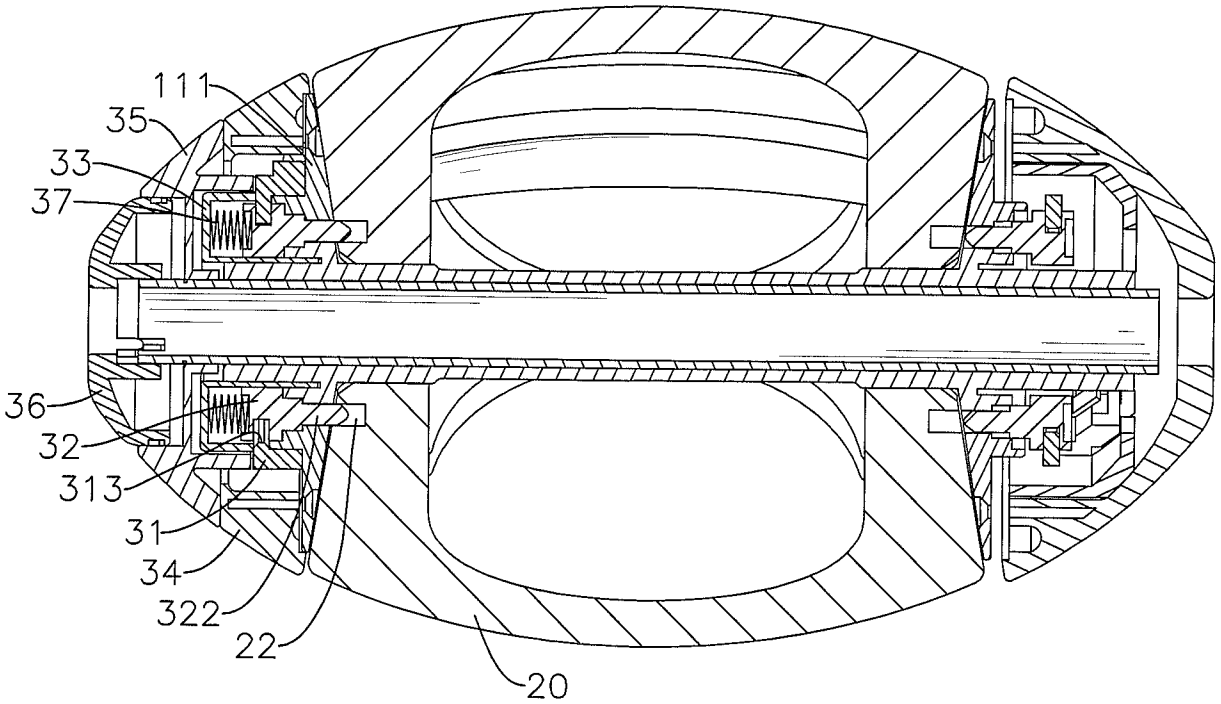
FIG. 7 is a second cross-sectional side view of the dumbbell in FIG. 1.
Figure 8:
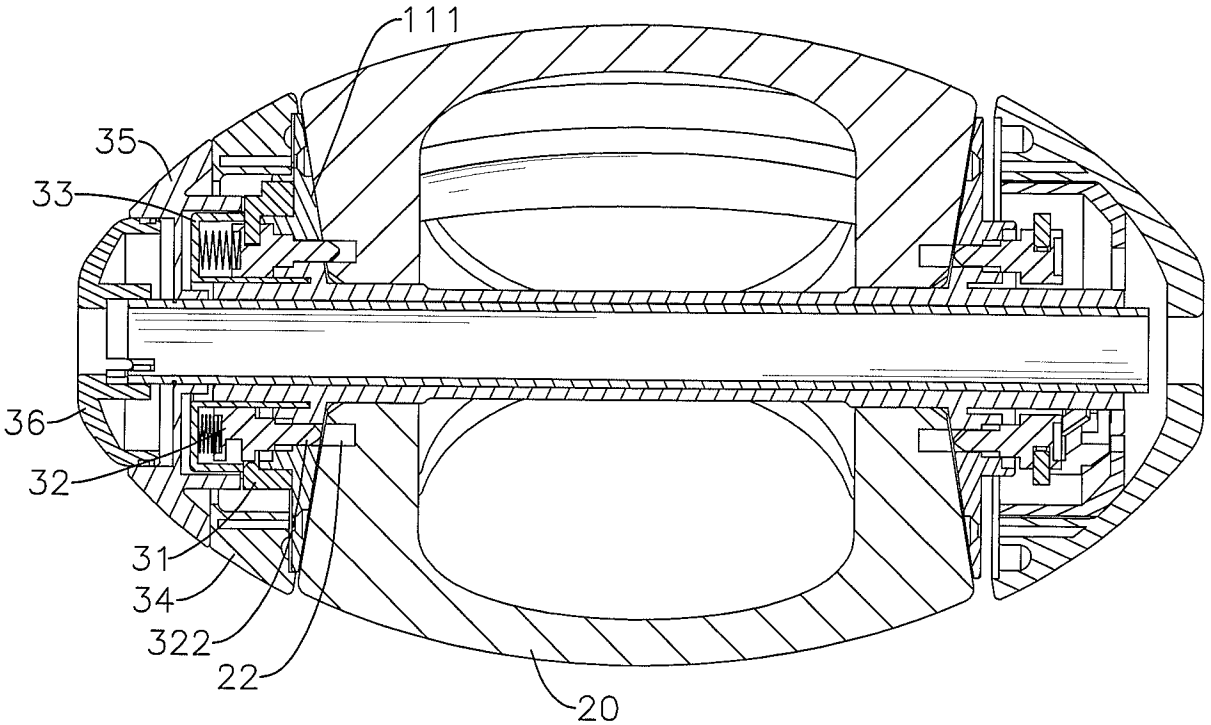
FIG. 8 is an operational cross-sectional side view of the dumbbell in FIG. 7.

With further reference to FIGS. 6 to 8, the adjusting seat 31 is circular, is rotatably mounted on the outer surface of the first end panel 111, and has an annular sidewall 311, an engaging ring 312, multiple engaging protrusions 314, and an abutting protrusion 315. The annular sidewall 311 is mounted around the first ring wall 1111 of the first end panel 111 and between the first ring wall 1111 and the stop protrusion 1112 of the first end panel 111. The annular sidewall 311 has an inner side surface, an outer side surface, and an outer end edge. The engaging ring 312 radially protrudes from the inner surface of the annular sidewall 311 and has an inner peripheral edge and a detaching recess 313. The detaching recess 313 is formed in the inner peripheral edge of the engaging ring 312. The engaging protrusions 314 separately protrude axially from the outer end edge of the annular sidewall 311. The abutting protrusion 315 radially protrudes from the outer side surface of the annular sidewall 311 and selectively abuts against the stop protrusion 1112 of the first end panel 111, to limit a rotatable range of the adjusting seat 31.

The first locking elements 32 are respectively mounted through the mounting holes 1113 of the first end panel 111 and engage with the inner peripheral edge of the engaging ring 312. The adjusting seat 31 is rotatable relative to the first locking elements 32. Each of the first locking elements 32 corresponds in width to the detaching recess 313 of the adjusting seat 31 and has a sidewall, an inner end, an engaging recess 321 and a locking rod 322. The engaging recess 321 of the first locking element 32 is formed in the sidewall of the first locking element 32 and receives the inner peripheral edge of the engaging ring 312 of the adjusting seat 31. The locking rod 322 of the first locking element 32 protrudes from the inner end of the first locking element 32, protrudes through the inner surface 1110 of the first end panel 111, and detachably engages in a corresponding one of the locking recesses 211 of a corresponding one of the weights 20.

The inner holding cap 33 is circular, is mounted over the engaging ring 312 of the adjusting seat 31, and is mounted around the first end of the handle 113 of the main support 11. The inner holding cap 33 is securely connected to the main support 11 by fasteners, such that the adjusting seat 31 is held between the first end panel 111 and the inner holding cap 33.

The restoring springs 37 are mounted between the first locking elements 32 and the inner holding cap 33. Each of the restoring springs 37 is a compression spring and has two ends respectively abutting the inner holding cap 33 and a corresponding one of the first locking elements 32, such that the first locking elements 32 are pushed toward and securely engage with the weights 20.

The covering panel 34 is circular, is mounted around the first end panel 111, and is securely connected to the first end panel 111 by fasteners.

The driving cap 35 is mounted to the covering panel 34, is connected to the adjusting seat 31, and selectively drives the at least one driving slat 13. The driving cap 35 has a sidewall 351, a base panel 352, an engaging ring 354, and a driving ring 356. The sidewall 351 of the driving cap 35 has an inner side surface. The base panel 352 is radially formed on the inner side surface of the sidewall 351 of the driving cap 35 and has an inner surface and a through hole 353. The inner surface of the base panel 352 faces toward the first end panel 111. The through hole 353 is formed through the base panel 352 and receives the first end of the axial tube 12. The engaging ring 354 axially protrudes from the inner surface of the base panel 352 and is connected to the annular sidewall 311 of the adjusting seat 31. The engaging ring 354 has an end edge and multiple engaging recesses 355. The engaging recesses 355 of the engaging ring 354 respectively engage the engaging protrusions 314 of the adjusting seat 31, such that the driving cap 35 and the adjusting seat 31 are securely connected with each other. The driving ring 356 is formed on the inner surface of the base panel 352 and around the through hole 353 of the base panel 352 and has an end edge, at least one concave portion 357, and at least one convex portion 358. The at least one concave portion 357 and the at least one convex portion 358 are formed on the end edge of the driving ring 356 and alternatively abut against the at least one driving slat 13. When the at least one convex portion 358 abuts against the at least one driving slat 13, the at least one driving slat 13 is pushed to slide toward the second end of the handle 113.

The first end cap 36 is mounted onto the driving cap 35 and is securely connected to the axial tube 12.

With further reference to FIGS. 9 and 10, the second end cap assembly 40 is mounted on the second end panel 112 of the main support 11 and selectively engages with the weights 20. The second end cap assembly 40 includes a connecting ring 41, multiple second locking elements 42, at least one holding element 43, an inner cap 44, and a second end cap 45.

The connecting ring 41 is mounted on the outer surface of the second end panel 112, is mounted on an end edge of the second ring wall 1121 of the second end panel 112 and around the second end of the handle 113, and has an inner peripheral edge and an outer peripheral edge.

The second locking elements 42 are respectively mounted through the mounting holes 1122 of the second end panel 112 and engage with the inner peripheral edge of the connecting ring 41. Each of the second locking elements 42 has a sidewall, an inner end, an engaging recess 421, and a locking rod 422. The engaging recess 421 of the second locking element 42 is formed in the sidewall of the second locking element 42 and receives the inner peripheral edge of the connecting ring 41. The locking rod 422 of the second locking element 42 protrudes from the inner end of the second locking element 42, protrudes through the inner surface 1120 of the second end panel 112, and detachably engages in a corresponding one of the locking recesses 211 of a corresponding one of the weights 20. With the locking rods 322, 422 of the first and second locking elements 32, 42 engaging in the locking recesses 211 of the weights 20, the weights 20 can be securely mounted on the main support 11 and does not drop from the main support 11.

The at least one holding element 43 is securely mounted on the outer peripheral edge of the connecting ring 41. Each of the at least one holding element 43 is abutted by the pushing portion 131 of a corresponding one of the at least one driving slat 13 and has a connecting hole 431.

The inner cap 44 is circular and is mounted on the outer surface of the second end panel 112 and around the connecting ring 41, the second locking elements 42, and the at least one holding element 43. The inner cap 44 is connected to the at least one holding element 43 and has an inner side surface and at least one connecting protrusion 441. The at least one connecting protrusion 441 radially protrudes from the inner side surface of the inner cap 44 and is mounted in the connecting hole 431 of the at least one holding element 43.

The second end cap 45 is mounted on the outer surface of the second end panel 112 and covers the inner cap 44, the connecting ring 41, the second locking elements 42, and the at least one holding element 43. The second end cap 45 has an inner surface and an axial hole 451. The inner surface of the second end cap 45 abuts against the inner cap 44 and the second end of the axial tube 12. The axial hole 451 is formed at a center of the second end cap 45 and aligns with the axial tube 12.

In the preferred embodiment, the handle assembly 10 includes two driving slats 13. The driving slats 13 are separately mounted between the handle 113 of the main support 11 and the axial tube 12 and are 180 degrees apart. The driving ring 356 of the driving cap 35 has two concave portions 357 and two convex portions 358. The concave portions 357 and the convex portions 358 are alternately disposed on the end edge of the driving ring 356. Specifically, the two concave portions 357 are 180 degrees apart, and the two convex portions 358 are 180 degrees apart. The second end cap assembly 40 includes two holding elements 43, such that the pushing portions 131 of the two driving slats 13 respectively abut the two holding elements 43.

When intending to adjust the training weight of the dumbbell of the present invention, the user can turn the driving cap 35.

Figure 11:
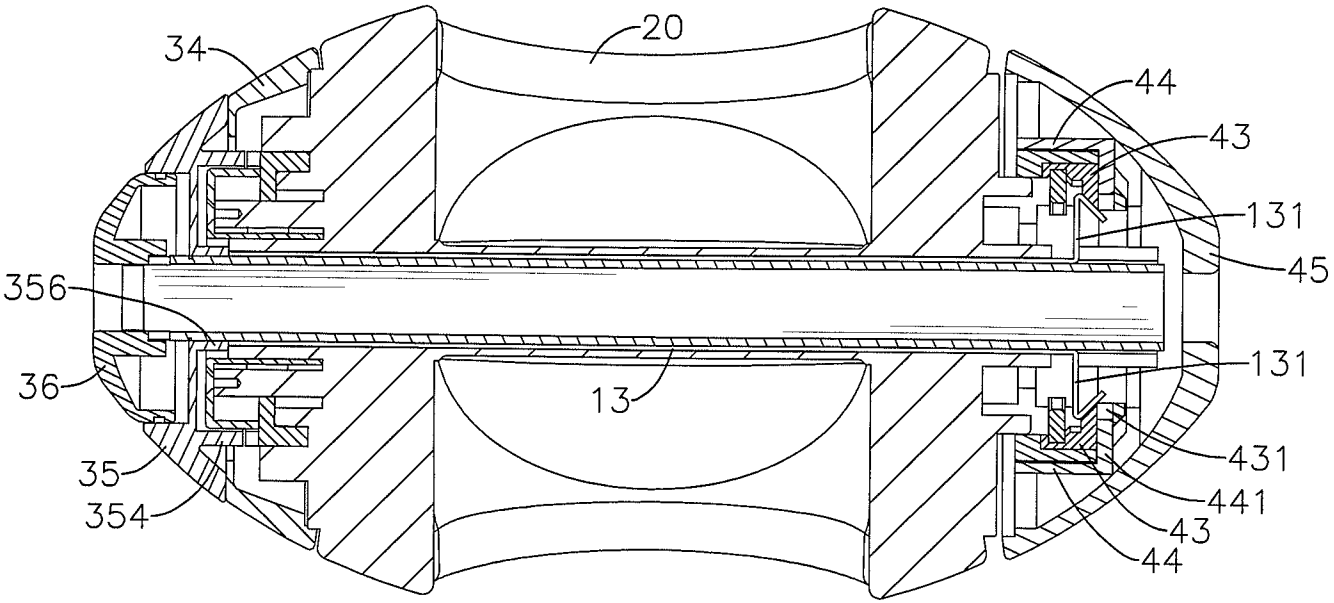
FIG. 11 is an operational cross-sectional side view of the dumbbell in FIG. 10.

With reference to FIGS. 10 and 11, as the driving ring 356 of the driving cap 35 is turned to allow the at least one convex portion 358 of the driving ring 356 to abut against the at least one driving slat 13, the at least one driving slat 13 slides toward the second end of the handle 113 of the main support 11 and pushes the at least one holding element 43 of the second end cap assembly 40 to slide. As the at least one holding element 43 slides, the second locking elements 42 and the inner cap 44 slide accordingly, and the inner cap 44 pushes the second end cap 45 to depart from the second end panel 112. Thus, the locking rods 422 of the second locking elements 42 disengage from the locking recesses 211 of the weights 20. Any one of the weights 20 can be radially detached from the main support 11, to adjust the training weight of the dumbbell. Since the weights 20 can be radially mounted onto or detached from the main support 11, an adjusting range of the training weight of the dumbbell can be increased.

Moreover, as the driving cap 35 is turned, the adjusting seat 31 is turned accordingly. When the detaching recess 313 of the adjusting seat 31 is turned to correspond in position to one of the first locking elements 32, the one first locking element 32 disengages from the engaging ring 312 of the adjusting seat 31 and can axially slide in a corresponding one of the mounting holes 1113 of the first end panel 111. Therefore, the weight 20 that is connected with the one first locking element 32 can be detached from the main support 11.

Figure 12:
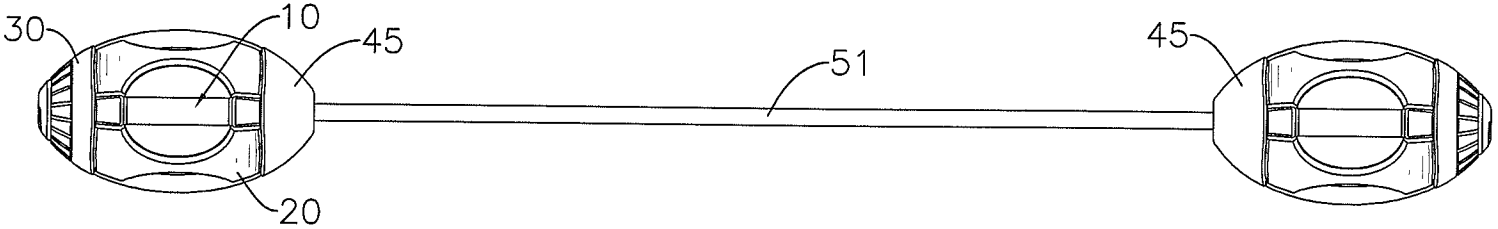
FIG. 12 is an operational side view showing two dumbbells of the present invention mounted on two ends of a gripping handle, to form a barbell.

With further reference to FIG. 12, two dumbbells of the present invention can be mounted on two opposite ends of a gripping handle 51, to form a barbell. The ends of the gripping handle 51 are respectively mounted in the axial hole 451 of the second end cap 45. In addition, two dumbbells of the present invention can be placed on a floor. The user performs a push-up with both of his hands holding the handles 113 of the two dumbbells. Thus, the hands of the user are positioned above the floor, and an up-and-down moving distance of a body of the user is increased. Accordingly, the exercising intensity of the push-up can be enhanced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dumbbell comprising:

a handle assembly including a main support, with the main support having:

a handle being tubular and having a first end and a second end;

a first end panel mounted on and around the handle and disposed adjacent to the first end of the handle, with the first end panel having an outer peripheral edge and an inner surface; and a second end panel mounted on and around the handle and disposed adjacent to the second end of the handle, with the second end panel having an outer peripheral edge, an outer surface, and an inner surface, and with the inner surface of the second end panel facing toward the inner surface of the first end panel;

multiple weights mounted between the first and second end panels of the main support, arranged around the handle, and being radially detachable from the main support;

a first end cap assembly mounted on the first end panel of the main support and selectively engaging with the multiple weights; and a second end cap assembly mounted on the second end panel of the main support and selectively engaging with the multiple weights, wherein:

the first end panel of the main support further has:

a first ring wall formed on an outer surface of the first end panel; and multiple mounting holes disposed between the first ring wall and an inner peripheral edge of the first end panel and arranged around the first end of the handle;

the second end panel of the main support further has multiple mounting holes;

the multiple mounting holes of the second end panel are separately arranged around the second end of the handle, and respectively align with the multiple mounting holes of the first end panel;

the handle assembly further includes:

an axial tube axially mounted through the handle of the main support and having a first end and a second end; and at least one driving slat mounted between the handle of the main support and the axial tube, with each of the at least one driving slat slidable along a long axial direction of the at least one driving slat and having a first end, a second end, and a pushing portion, and with the pushing portion being bent and formed on the second end of the at least one driving slat;

each of the multiple weights has:

two end surfaces respectively corresponding in position to one of the multiple mounting holes of the first end panel and one of the multiple mounting holes of the second end panel, with each of the two end surfaces being fan-shaped in cross-section; and two locking recesses respectively formed in the two end surfaces of the weight;

the first end cap assembly includes:

an adjusting seat being circular, rotatably mounted on the outer surface of the first end panel and having:

an annular sidewall mounted around the first ring wall of the first end panel; and an engaging ring radially protruding from an inner surface of the annular sidewall and having an inner peripheral edge; and multiple first locking elements respectively mounted through the multiple mounting holes of the first end panel and engaging with the inner peripheral edge of the engaging ring, with each of the multiple first locking elements having a locking rod, with the locking rod of the first locking element protruding from an inner end of the first locking element, protruding through the inner surface of the first end panel, and detachably engaging in a corresponding one of the two locking recesses of a corresponding one of the multiple weights;

the adjusting seat is rotatable relative to the multiple first locking elements;

a driving cap is connected to the adjusting seat and selectively drives the at least one driving slat, with the driving cap having:

a sidewall;

a base panel radially formed on an inner side surface of the sidewall of the driving cap and having a through hole, with the through hole formed through the base panel and receiving the first end of the axial tube;

an engaging ring axially protruding from an inner surface of the base panel and connected to the annular sidewall of the adjusting seat; and a driving ring formed on the inner surface of the base panel and around the through hole of the base panel and having an end edge, at least one concave portion, and at least one convex portion, and the at least one concave portion and the at least one convex portion alternatively abutting against the at least one driving slat; and the second end cap assembly includes:

a connecting ring mounted on the outer surface of the second end panel and around the second end of the handle;

multiple second locking elements respectively mounted through the multiple mounting holes of the second end panel and engaging with an inner peripheral edge of the connecting ring, with each of the multiple second locking elements having a locking rod, with the locking rod of the second locking element protruding from an inner end of the second locking element, protruding through the inner surface of the second end panel, and detachably engaging in a corresponding one of the two locking recesses of a corresponding one of the multiple weights;

at least one holding element securely mounted on an outer peripheral edge of the connecting ring, with each of the at least one holding element abutted by the pushing portion of a corresponding one of the at least one driving slat; and an inner cap being circular and mounted on the outer surface of the second end panel and around the connecting ring, the second locking elements, and the at least one holding element, with the inner cap connected to the at least one holding element.

2. The dumbbell as claimed in claim 1, wherein the first end cap assembly further includes:

an inner holding cap being circular, mounted over the engaging ring of the adjusting seat, mounted around the first end of the handle of the main support, and securely connected to the main support; and multiple restoring springs mounted between the multiple first locking elements and the inner holding cap, with each of the multiple restoring springs having two ends respectively abutting the inner holding cap and a corresponding one of the first multiple locking elements.

3. The dumbbell as claimed in claim 2, wherein the engaging ring of the adjusting seat has a detaching recess formed in the inner peripheral edge of the engaging ring of the adjusting seat and corresponding in width to each of the multiple first locking elements.

4. The dumbbell as claimed in claim 1, wherein:

the inner surface of the first end panel inclines between the inner peripheral edge of the first end panel and the outer peripheral edge of the first end panel;

the inner peripheral edge of the first end panel is convex toward the second end of the handle;

the inner surface of the second end panel inclines between an inner peripheral edge of the second end panel and the outer peripheral edge of the second end panel;

the inner peripheral edge of the second end panel is convex toward the first end of the handle; and each of the two end surfaces of the weight is inclined to fit the inner surfaces of the first and second end panels.

5. The dumbbell as claimed in claim 2, wherein:

the inner surface of the first end panel inclines between the inner peripheral edge of the first end panel and the outer peripheral edge of the first end panel;

the inner peripheral edge of the first end panel is convex toward the second end of the handle;

the inner surface of the second end panel inclines between an inner peripheral edge of the second end panel and the outer peripheral edge of the second end panel;

the inner peripheral edge of the second end panel is convex toward the first end of the handle; and each of the two end surfaces of the weight is inclined to fit the inner surfaces of the first and second end panels.

6. The dumbbell as claimed in claim 3, wherein:

the inner surface of the first end panel inclines between the inner peripheral edge of the first end panel and the outer peripheral edge of the first end panels;

the inner peripheral edge of the first end panel is convex toward the second end of the handle;

the inner surface of the second end panel inclines between an inner peripheral edge of the second end panel and the outer peripheral edge of the second end panel;

the inner peripheral edge of the second end panel is convex toward the first end of the handle; and each of the two end surfaces of the weight is inclined to fit the inner surfaces of the first and second end panels.

7. The dumbbell as claimed in claim 4, wherein:

the first end panel further has a stop protrusion;

the stop protrusion is formed on the outer surface of the first end panel and is disposed between the first ring wall and the outer peripheral edge of the first end panel;

the adjusting seat further has an abutting protrusion; and the abutting protrusion radially protrudes from an outer side surface of the annular sidewall of the adjusting seat and selectively abuts against the stop protrusion of the first end panel.

8. The dumbbell as claimed in claim 5, wherein:

the first end panel further has a stop protrusion;

the stop protrusion is formed on the outer surface of the first end panel and is disposed between the first ring wall and the outer peripheral edge of the first end panel;

the adjusting seat further has an abutting protrusion; and the abutting protrusion radially protrudes from an outer side surface of the annular sidewall of the adjusting seat and selectively abuts against the stop protrusion of the first end panel.

9. The dumbbell as claimed in claim 6, wherein:

the first end panel further has a stop protrusion;

the stop protrusion is formed on the outer surface of the first end panel and is disposed between the first ring wall and the outer peripheral edge of the first end panel;

the adjusting seat further has an abutting protrusion; and the abutting protrusion radially protrudes from an outer side surface of the annular sidewall of the adjusting seat and selectively abuts against the stop protrusion of the first end panel.

10. The dumbbell as claimed in claim 7, wherein:

the handle assembly further includes multiple side bars;

the multiple side bars are disposed between the first and second end panels of the main support and are separately arranged around the handle along with the multiple weights; and each of the multiple side bars has two ends respectively connected securely to the first and second end panels.

11. The dumbbell as claimed in claim 8, wherein:

the handle assembly further includes multiple side bars;

the multiple side bars are disposed between the first and second end panels of the main support and are separately arranged around the handle along with the multiple weights; and each of the multiple side bars has two ends respectively connected securely to the first and second end panels.

12. The dumbbell as claimed in claim 9, wherein:

the handle assembly further includes multiple side bars;

the multiple side bars are disposed between the first and second end panels of the main support and are separately arranged around the handle along with the multiple weights; and each of the multiple side bars has two ends respectively connected securely to the first and second end panels.

13. The dumbbell as claimed in claim 10, wherein each of the multiple weights further has two lateral indentations respectively formed in two opposite sides of the weight.

14. The dumbbell as claimed in claim 11, wherein each of the multiple weights further has two lateral indentations respectively formed in two opposite sides of the weight.

15. The dumbbell as claimed in claim 12, wherein each of the multiple weights further has two lateral indentations respectively formed in two opposite sides of the weight.

16. The dumbbell as claimed in claim 1, wherein:

the first end cap assembly further includes a first end cap;

the first end cap is mounted onto the driving cap and is securely connected to the axial tube;

the second end cap assembly further includes a second end cap; and the second end cap is mounted on the outer surface of the second end panel and has:

an inner surface abutting against the inner cap and the second end of the axial tube; and an axial hole formed at a center of the second end cap and aligning with the axial tube.

17. The dumbbell as claimed in claim 1, wherein:

the second end panel further has a second ring wall;

the second ring wall is formed on the outer surface of the second end panel and surrounds the second end of the handle;

the mounting holes of the second end panel are disposed between the second ring wall and an inner peripheral edge of the second end panel; and the connecting ring is mounted on an end edge of the second ring wall.

* * * * *